US008551306B2

(12) United States Patent
Palmu et al.

(10) Patent No.: US 8,551,306 B2
(45) Date of Patent: Oct. 8, 2013

(54) PERMANENT CATHODE

(75) Inventors: Lauri Palmu, Helsinki (FI); Henri Virtanen, Pori (FI); Tuomo Kivistö, Jorvas (FI); Ismo Virtanen, Pori (FI)

(73) Assignee: Outotec Oyj, Espoo (FI)

( * ) Notice: Subject to any disclaimer, the term of this patent is extended or adjusted under 35 U.S.C. 154(b) by 122 days.

(21) Appl. No.: 13/063,705

(22) PCT Filed: Oct. 1, 2009

(86) PCT No.: PCT/FI2009/050791

§ 371 (c)(1),
(2), (4) Date: Jun. 20, 2011

(87) PCT Pub. No.: WO2010/037909

PCT Pub. Date: Apr. 8, 2010

(65) Prior Publication Data

US 2011/0259737 A1 Oct. 27, 2011

(30) Foreign Application Priority Data

Oct. 1, 2008 (FI) ..... 20085928

(51) Int. Cl.
*C25D 1/04* (2006.01)
*B23H 3/04* (2006.01)
*C25B 11/02* (2006.01)

(52) U.S. Cl.
USPC ..... 204/281; 204/286.1; 204/297.01

(58) Field of Classification Search
USPC ..... 204/281, 286.1, 297.01
See application file for complete search history.

(56) References Cited

U.S. PATENT DOCUMENTS

| | | | | |
|---|---|---|---|---|
| 3,798,151 | A | 3/1974 | Takamura et al. | |
| 5,865,967 | A * | 2/1999 | Hiai et al. | 204/281 |
| 6,632,333 | B1 * | 10/2003 | Eriksson et al. | 204/227 |
| 7,807,028 | B2 * | 10/2010 | Webb | 204/281 |
| 2010/0078319 | A1 * | 4/2010 | Palmu | 204/293 |

FOREIGN PATENT DOCUMENTS

| | | | |
|---|---|---|---|
| GB | 1 329 030 | A | 9/1973 |
| WO | WO 2004/097076 | A1 | 11/2004 |

OTHER PUBLICATIONS

International Search Report (PCT/ISA/210) issued on Dec. 11, 2009, by Finnish Patent Office as the International Searching Authority for International Application No. PCT/FI2009/050791.

* cited by examiner

*Primary Examiner* — Bruce Bell
(74) *Attorney, Agent, or Firm* — Buchanan Ingersoll & Rooney PC

(57) ABSTRACT

A permanent cathode that is to be used as electrode in the electro-refining and/or recovery of metals, such as copper, zinc, cobalt or nickel. The permanent cathode comprises a planar mother plate that is made of metal and comprises two sides. The mother plate comprises an edge, which at least partly surrounds the metal plate. The edge comprises a groove portion that is provided with a groove. The groove portion comprises at least one bridging section for joining together, over the groove portion of the edge of the metal plate at the at least one bridging section, the cathode metal halves, such as cathode copper halves, cathode zinc halves, cathode cobalt halves or cathode nickel halves, which are formed on the sides of the mother plate in the electro-refining of the metals.

19 Claims, 5 Drawing Sheets

C-C:

D-D:

A-A:

B-B:

C-C:

D-D:

E-E:

F-F:

G-G:

H-H:

I-I:

J-J:

K:K:

L-L:

M-M:

N-N:

O-O:

P-P:

PERMANENT CATHODE

BACKGROUND OF THE INVENTION

The invention relates to a permanent cathode to be used as electrode in the electro-refining and/or recovery of metals, such as copper, zinc, cobalt or nickel.

The invention can be applied, for example, to the electro-refining of copper, wherein anode copper in the form of anodes is transferred onto cathodes by means of an electric current to provide cathode copper. The electro-refining of copper takes place is tanks, in which the anode copper and cathodes are placed by turns and which contain electrolytic liquid. The invention can also be applied, for example, to the electrolytic recovery of copper, nickel, cobalt or zinc.

At present, modern metal electrolyses mainly use what is called a permanent cathode technology, which is based on reducing a metal, such as copper, onto the surface of the mother plate of a permanent cathode made of a suitable steel grade. The metal in the form of a cathode metal half, such as a cathode copper half, is easy to strip from the surface of such a mother plate by a machine (stripping machine) that is built for the stripping. An advantage of the process over the conventional starter sheet technology includes the ability to recycle the permanent cathodes back to the process, and their good flatness (straightness).

The first permanent cathode plants employed what is called the ISA technology, wherein the detachability of the cathode metal was ensured by using a suitable wax both in connection with the edge strips on the sides of the mother plate and on the bottom edge of the mother plate. In the method, one permanent cathode always yields two separate cathode metal halves (both growth halves are separated, the weight being half of the conventional cathode metal). However, the wax used in the method may cause problems both in the electrolysis process and the quality of the cathode metal. Some also consider the light weight of the cathode metal halves to be a problem, as it influences the casting capacity of the foundry in foundries, where the cathodes are fed into the melting furnace one by one.

Another prevailing permanent technology used is the so-called Kidd process, wherein the waxing of the bottom edge of the mother plate of the permanent cathode is omitted and the cathode metal halves are allowed to grow together at their bottom edges, resulting in what is called a taco cathode. If the bottom edge of the permanent cathode plate is completely flat, problems may arise when stripping the metal, as the metal partly gets stuck at the bottom edge of the mother plate. Due to this, the cathode metals thus obtained may have to be pressed straight or straightened in another way, since in stripping, the lower parts of the cathode metal halves curve to some extent, forming a crease/bag.

Both technologies have further been improved by cutting a V groove on the bottom edge of the permanent cathode mother plate. When a suitably deep V groove is used in the ISA technology, the cathode metal halves break off from each other at their bottom edges without waxing. In the Kidd technology, the V groove furthers the stripping of the cathode metal but may cause the cathode metal halves to break off from each other. In that case, some metal cathodes are of the taco style and some are of the ISA style. This in turn may be problematic for the user of the cathode.

In addition to the depth and shape of the groove, the running parameters used in the electrolysis also influence the detachment of the cathode metal halves from each other, when producing taco cathodes. These include, among others, the composition of the electrolyte, e.g., the additives and temperature, the mutual dimensions of the anodes and the cathodes, and their distance from each other and the current density used. Consequently, optimizing the depth and the shape of the groove may be quite challenging, as different electrolytic plants have their own preferences regarding the running parameters of the process.

Publication U.S. Pat. No. 3,798,151 presents a permanent cathode plate.

Publication WO 2004/097076 presents a permanent cathode plate.

SHORT DESCRIPTION OF THE INVENTION

The object of the invention is to provide a novel permanent cathode, which solves the problems mentioned above.

The object of the invention is achieved by the permanent cathode.

The preferred embodiments of the invention are described in the dependent claims.

The structure of the edge of the permanent cathode mother plate according to the invention ensures the adhesion of the cathode metal halves, such as cathode copper halves, to each other when stripping the cathodes.

In a preferred embodiment of the permanent cathode according to the invention, the edge of the permanent cathode mother plate comprises two essentially parallel side edges and a bottom edge. In this preferred embodiment, a groove portion is formed on the bottom edge and the groove portion comprises at least one V groove and at least one flat portion that provides a bridging section between the sides of the mother plate. Such a structure combines the best properties of both the V groove and the flat bottom edge, so that the V groove ensures an easy stripping of the cathode metal and the straight portion ensures the adhesion of the cathode metal halves, such as cathode copper halves, to each other (a "hinge"). For example, at least one V groove is cut in the main part of the mother plate bottom edge but, e.g., a straight bottom edge or a corresponding bridging section is left to extend over an adequately long distance. For example, the straight bottom edge can comprise one section in the middle of the mother plate bottom edge and the length of the straight bottom edge may be about 5-about 50 cm, more preferably about 10-about 40 cm, most preferably about 20-about 30 cm, or it may consist of several short sections. In addition to the adhesion of the cathode metal halves, such as cathode copper halves, one advantage of the structure is that the short straight section does not cause a crease/bag in the lower part of the cathode metal halves, such as cathode copper halves. In that case, the separate pressing straight or straightening of the cathode metal, such as cathode copper, is not needed.

The principles of the invention are found in the structure of the metal, such as copper, which is reduced onto the bottom edge of the permanent cathode mother plate. Without the V groove, the metal, such as copper, precipitates as uniform growth that has no separate boundary surface to facilitate breaking. With the V groove, a clear fracture zone is formed in the growth of the metal, along which the detachment of the cathode metal halves, such as cathode copper halves, from each other takes place.

LIST OF FIGURES

In the following, some preferred embodiments of the invention are described in detail with reference to the appended figures, wherein.

DETAILED DESCRIPTION OF THE INVENTION

Figure 1:
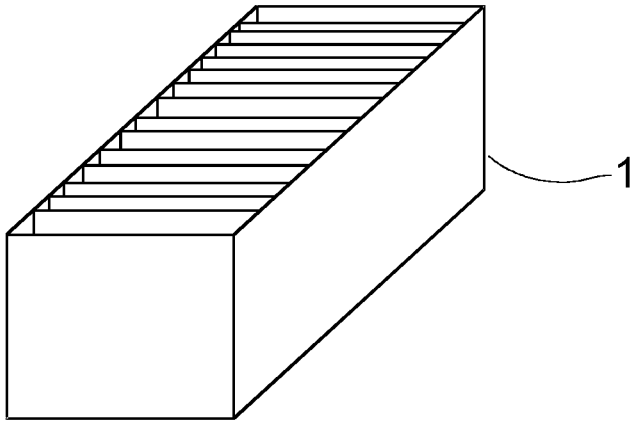
FIG. 1 shows an electrolytic tank that comprises anodes and permanent cathodes.
Figure 2:
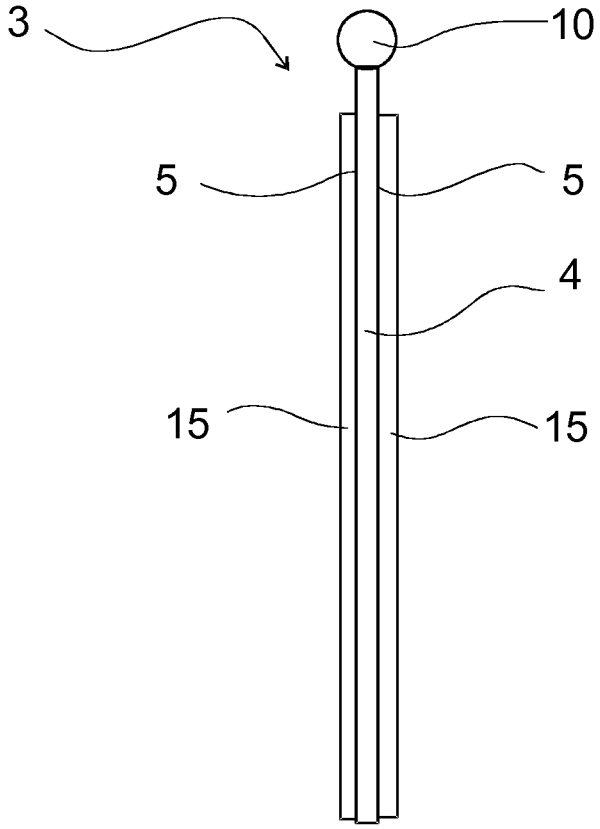
FIG. 2 shows a side view of the permanent cathode, a cathode metal half being formed on the opposite side of its mother plate.

FIG. 1 shows the electrolytic tank 1, which is used in the electro-refining and/or recovery of metals, such as copper, nickel, cobalt or zinc. In the electrolytic tank 1 shown in FIG. 1, anodes 2 and permanent cathodes 3 are placed alternately. In case of electro-refining copper, the anodes 2 would consist of what is called anode copper and the cathodes would be the permanent cathodes 3 mentioned above, onto the mother plate of which the so-called cathode copper would be reduced in the electrolytic process.

The figures show the permanent cathode 3 that is to be used as electrode in the electro-refining and/or recovery of metals, such as copper, nickel, cobalt or zinc.

The permanent cathode 3 comprises a planar mother plate 4 that is made of metal and comprises two sides 5.

The mother plate 4 comprises an edge 6, which at least partly surrounds the metal plate.

The edge 6 comprises a groove portion 8 provided with a groove 7.

The groove portion 8 comprises at least one bridging section 9 for joining together, over the groove portion 8 of the edge 6 of the mother plate 4 at the said at least one bridging section 9, the cathode metal halves 15, such as cathode copper halves, cathode nickel halves, cathode cobalt halves or cathode zinc halves, which are formed on the sides 5 of the mother plate 4 in the electro-refining of the metals.

In accordance with the invention it is possible that the groove portion 8 is dimensioned and/or designed such that the cathode metal halves 15 that are formed in electro-refining or electrowinning of metal on the sides 5 of the mother plate 4 are configured to at least partly be connected over the groove portion 8 of the edge 6 of the mother plate 4, and that said at least one bridging section 9 of the groove portion 8 is dimensioned and/or designed such that between the cathode metal halves 15 is at a such bridging section 9 of the groove portion 8 configured to be formed a stronger connection between the cathode metal halves 15 over the edge 6 of the mother plate 4 than between the cathode metal halves 15 over the edge 6 of the mother plate 4 at other parts of the groove portion 8.

In addition, the mother plate 4 shown in the figures comprises a suspension means 10 of the metal plate.

In the permanent cathodes 3 shown in FIGS. 3, 6, 9, 12, 15, 18, 21 and 24, the edge 6 of the mother plate 4 comprises two essentially parallel side edges 11 and a bottom edge 12.

The groove portion 8 in the permanent cathodes 3 shown in FIGS. 3, 6, 9, 12, 15, 18, 21 and 24 is formed on the bottom edge 12 of the mother plate 4.

Deviating from FIGS. 3, 6, 9, 12, 15, 18, 21 and 24, it is possible that between each essentially parallel side edge 11 and the bottom edge 12, there is a straight and/or curved angular edge portion (not shown), that the groove portion 8 extends to at least one angular edge portion.

If the mother plate 4 comprises two parallel side edges 11, it is possible that at least one of the essentially parallel side edges 11 may be provided with an edge strip 13. In FIGS. 3, 6, 9, 12, 15, 18, 21 and 24, each parallel side edge 11 is provided with an edge strip 13.

According to the invention, it is possible that the groove portion 8 comprises several grooves and that the bridging section 9 is located between two grooves 7, as shown in FIGS. 9, 12, 15, 18 and 21.

Figure 4:
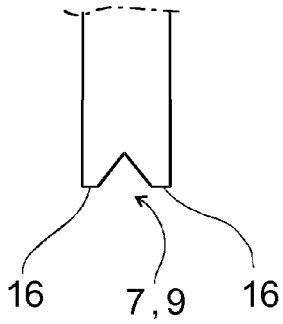
FIG. 4 shows a detail of the permanent cathode shown in FIG. 3, cut along the line A-A of FIG. 3.
Figure 5:
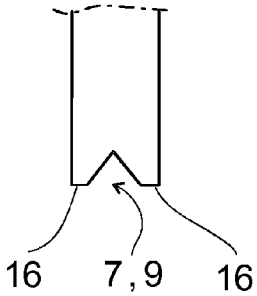
FIG. 5 shows a detail of the permanent cathode shown in FIG. 3, cut along the line B-B of FIG. 3.
Figure 6:
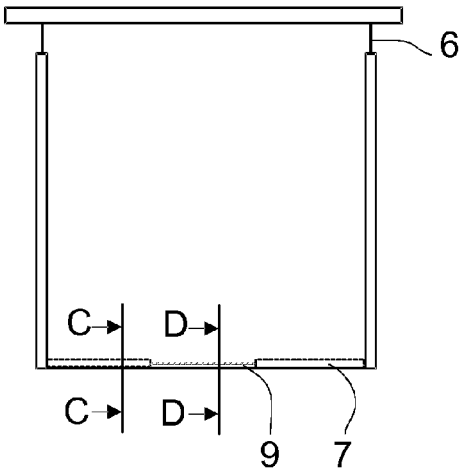
FIG. 6 shows a second preferred embodiment of the permanent cathode according to the invention.
Figure 8:
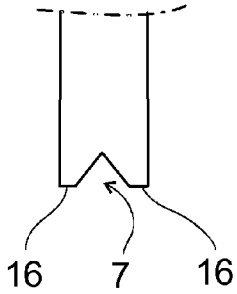
FIG. 8 shows a detail of the permanent cathode shown in FIG. 6, cut along the line D-D of FIG. 6.

According to the invention, it is possible that the bridging section 9 is formed in the groove 7 so that a portion lower than the rest of the groove 7 is formed in the groove 7, providing the bridging section 9 over the groove 7, as shown in FIG. 6. For example, it is possible that in a groove 7 having a depth of within about 1-about 1.5 mm, a portion lower than the rest of the groove 7 is formed, which provides the bridging section 9 over the groove and has a depth of within about 0.25-about 1 mm, more preferably within about 0.25-about 0.75 mm and most preferably within about 0.25-about 0.5 mm. In other words, it is possible, e.g., that the depth of the groove 7 outside the bridging section 9 is about 1-about 1.5 mm, and that the depth of the groove 7 at the bridging section 9 is about 0.25-about 1 mm, more preferably about 0.25-about 0.75 mm and most preferably about 0.25-about 0.5 mm. If a portion lower than the rest of the groove 7 is formed in the groove 7, providing the bridging section 9 over the groove 7, the edge 6 of the mother plate 4 preferably but not necessarily comprises, at the bridging section 9, both the groove 7 and an essentially flat portion 16, as shown in FIGS. 4, 5 and 8.

According to the invention, it is possible that the metal plate at the bridging section 9 is essentially flat or groove-free, as shown in FIGS. 9, 12, 15, 18 and 21.

According to the invention, it is possible that the bridging section 9 forms an essentially flat portion at the groove section 8, as shown in FIGS. 9, 12, 15, 18 and 21.

The groove 7 is preferably, but not necessarily, a V groove.

Figure 24:
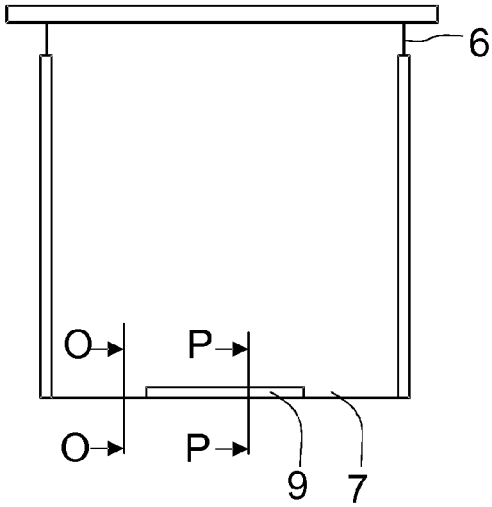
FIG. 24 shows a ninth preferred embodiment of the permanent cathode according to the invention.
Figure 25:
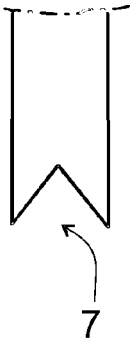
FIG. 25 shows a detail of the permanent cathode shown in FIG. 24, cut along the line O-O of FIG. 24.
Figure 26:
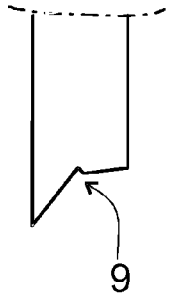
FIG. 26 shows a detail of the permanent cathode shown in FIG. 24, cut along the line P-P of FIG. 24.

If the groove 7 is a V groove, it is possible that the bridging section 9 is formed by at least partly removing, from the V groove, the other half of the part of the metal plate that forms the V groove at the bridging section 9, as shown in FIGS. 24-26. The width of the bridging section 9 is preferably, but not necessarily, about 5-about 50 cm, more preferably about 10-about 40 cm and most preferably, but not necessarily, about 20-about 30 cm long.

In the following, some preferred embodiments of the mother plate 4 according to the invention are described in detail.

Figure 3:
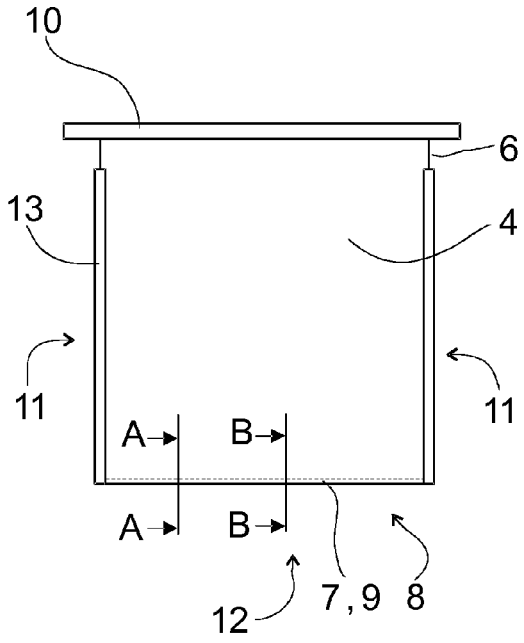
FIG. 3 shows a first preferred embodiment of the permanent cathode according to the invention.

FIGS. 3-5 show a first preferred embodiment of the permanent cathode 3 according to the invention. The mother plate 4 therein comprises a bottom edge 12, which comprises a groove portion 8 provided with a V groove. The V groove extends throughout the length of the bottom edge 12; in other words, throughout the groove portion 8. In FIGS. 3-5, the depth of the V groove is lower than normal, so that the bridging section 9 is formed throughout the width of the bottom edge to join together, over the bottom edge 12 of the mother plate 4, the cathode metal halves 15, which are formed on the sides 5 of the mother plate 4 in the electrolytic process. For example, it is possible that when the normal depth of such a groove 7 is within about 1-about 1.5 mm, a groove 7 is formed in the embodiment according to FIGS. 3-5, the depth of which is within about 0.25-about 1 mm, more preferably within about 0.25-about 0.75 mm and most preferably within about 0.25-about 0.5 mm. Since the depth of the groove 7 in the embodiment according to FIGS. 3-5 is lower than normal, both a groove 7 and a flat portion 16 on both sides of the groove 7 are formed throughout the length of the bottom edge 12 of the mother plate 4 in the embodiment according to FIGS. 3-5.

Figure 7:
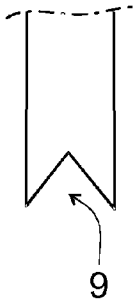
FIG. 7 shows a detail of the permanent cathode shown in FIG. 6, cut along the line C-C of FIG. 6.

FIGS. 6-8 show a second preferred embodiment of the permanent cathode 3 according to the invention. The mother plate 4 therein comprises a bottom edge 12, which comprises a groove portion 8 provided with two V grooves 7. Between the V grooves in the groove portion 8, there is a portion that has a depth lower than the V grooves and that forms the bridging section 9 to join together, over the bottom edge 12 of the mother plate 4, the cathode metal halves 15, which are formed on the sides 5 of the mother plate 4 in the electrolytic process. Since the depth of the groove 7 at the bridging section 9 in the embodiment according to FIGS. 6-8 is lower than normal, both a groove 7 and a flat portion 16 on both sides of the groove 7 are formed on the bottom edge 12 of the mother plate 4 at the bridging section 9 in the embodiment according to FIGS. 6-8.

Figure 9:
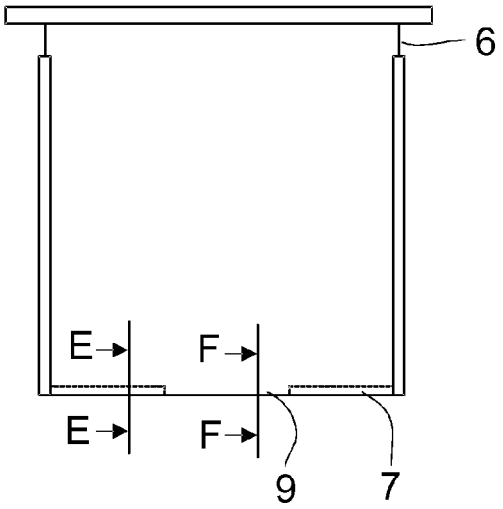
FIG. 9 shows a third preferred embodiment of the permanent cathode according to the invention.
Figure 10:
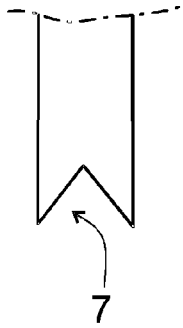
FIG. 10 shows a detail of the permanent cathode shown in FIG. 9, cut along the line E-E of FIG. 9.
Figure 11:
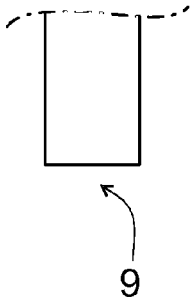
FIG. 11 shows a detail of the permanent cathode shown in FIG. 9, cut along the line F-F of FIG. 9.

FIGS. 9-11 show a third preferred embodiment of the permanent cathode 3 according to the invention. The mother plate 4 therein comprises a bottom edge 12, which comprises a groove portion 8 provided with two V grooves 7. The said two V grooves are separated from each other by a flat portion that forms the bridging section 9 to join together, over the bottom edge 12 of the mother plate 4, the cathode metal halves 15, which are formed on the sides 5 of the mother plate 4 in the electrolytic process.

Figure 12:
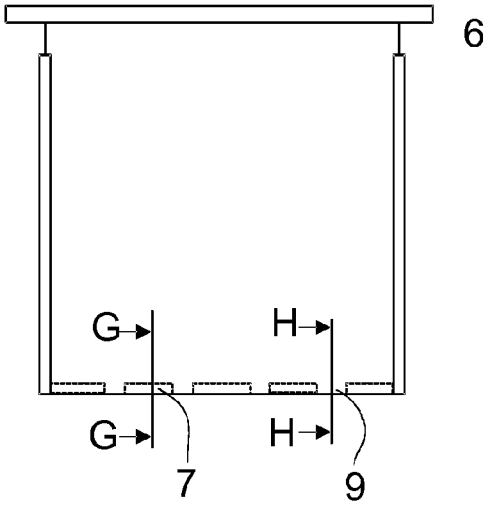
FIG. 12 shows a fourth preferred embodiment of the permanent cathode according to the invention.
Figure 13:
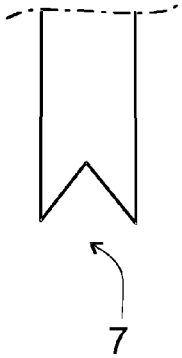
FIG. 13 shows a detail of the permanent cathode shown in FIG. 12, cut along the line G-G of FIG. 12.
Figure 14:
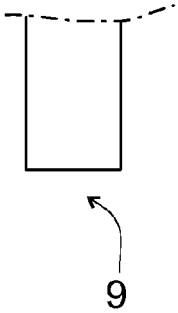
FIG. 14 shows a detail of the permanent cathode shown in FIG. 12, cut along the line H-H of FIG. 12.

FIGS. 12-14 show a fourth preferred embodiment of the permanent cathode 3 according to the invention. The mother plate 4 therein comprises a bottom edge 12, which comprises a groove portion 8 provided with five V grooves 7. The said five V grooves are separated from each other by four flat portions, each one of them forming a bridging section 9 to join together, over the bottom edge 12 of the mother plate 4, the cathode metal halves 15, which are formed on the sides 5 of the mother plate 4 in the electrolytic process.

Figure 15:
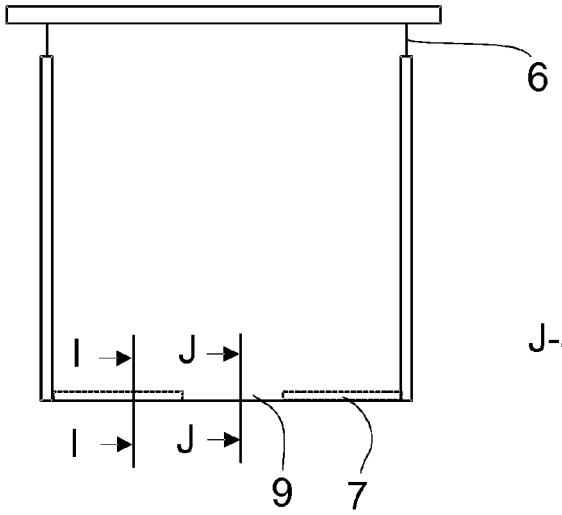
FIG. 15 shows a fifth preferred embodiment of the permanent cathode according to the invention.
Figure 16:
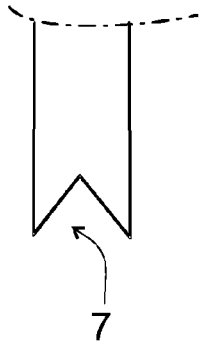
FIG. 16 shows a detail of the permanent cathode shown in FIG. 15, cut along the line I-I of FIG. 15.
Figure 17:
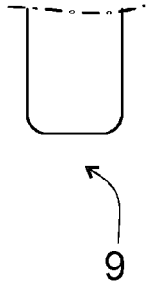
FIG. 17 shows a detail of the permanent cathode shown in FIG. 15, cut along the line J-J of FIG. 15.

FIGS. 15-17 show a fifth preferred embodiment of the permanent cathode 3 according to the invention. The mother plate 4 therein comprises a bottom edge 12, which comprises a groove portion 8 provided with two V grooves 7. The said two V grooves 7 are separated from each other by a flat portion, which has a rounded edge between the side 5 of the mother plate 4 and the bottom edge 12 of the mother plate 4 and which forms a bridging section 9 to join together, over the bottom edge 12 of the mother plate 4, the cathode metal halves 15, which are formed on the sides 5 of the mother plate 4 in the electrolysis process.

Figure 18:
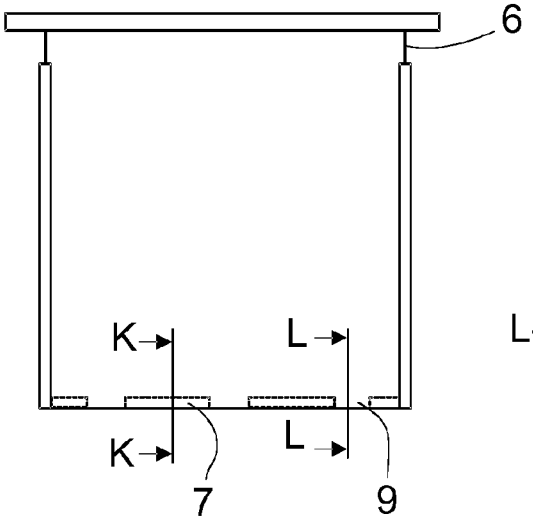
FIG. 18 shows a sixth preferred embodiment of the permanent cathode according to the invention.
Figure 19:
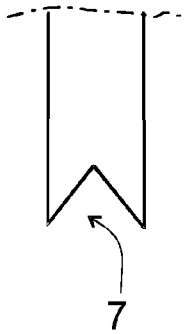
FIG. 19 shows a detail of the permanent cathode shown in FIG. 18, cut along the line K-K of FIG. 18.
Figure 20:
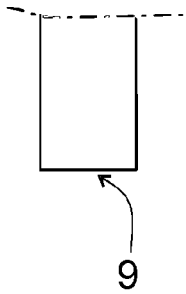
FIG. 20 shows a detail of the permanent cathode shown in FIG. 18, cut along the line L-L of FIG. 18.

FIGS. 18-20 show a sixth preferred embodiment of the permanent cathode 3 according to the invention. The mother plate 4 therein comprises a bottom edge 12, which comprises a groove portion 8 provided with four V grooves 7. The said four V grooves 7 are separated from each other by three flat portions, each one of them forming a bridging section 9, which forms a bridging section 9 to join together, over the bottom edge 12 of the mother plate 4, the cathode metal halves 15, which are formed on the sides 5 of the mother plate 4 in the electrolytic process, 15 to join together over the bottom edge 12 of the mother plate 4.

Figure 21:
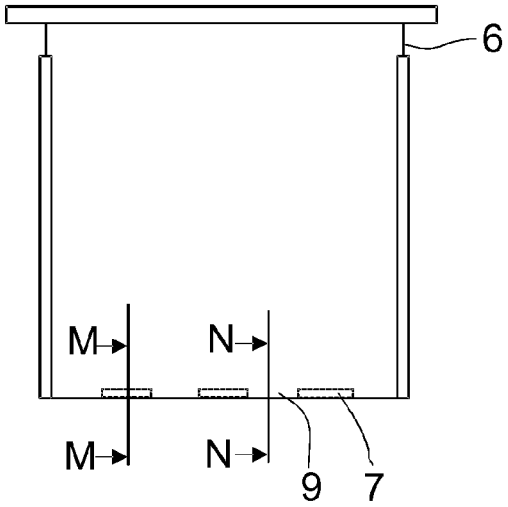
FIG. 21 shows a seventh preferred embodiment of the permanent cathode according to the invention.
Figure 22:
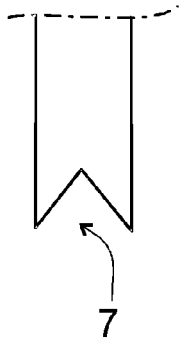
FIG. 22 shows a detail of the permanent cathode shown in FIG. 21, cut along the line M-M of FIG. 21.
Figure 23:
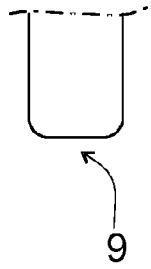
FIG. 23 shows a detail of the permanent cathode shown in FIG. 21, cut along the line N-N of FIG. 21.

FIGS. 21-23 show a seventh preferred embodiment of the permanent cathode 3 according to the invention. The mother plate 4 therein comprises a bottom edge 12, which comprises a groove portion 8 provided with three V grooves 7. The said theree V grooves 7 are separated from each other by four flat portions, which have a rounded edge between the side 5 of the mother plate 4 and the bottom edge 12 of the mother plate 4, each one of them forming a bridging section 9, which forms the bridging section 9 to join together, over the bottom edge 12 of the mother plate 4, the cathode metal halves 15, which are formed on the sides 5 of the mother plate 4 in the electrolytic process, 15 to join together over the bottom edge 12 of the mother plate 4.

FIGS. 24-26 show an eight preferred embodiment of the permanent cathode 3 according to the invention. The mother plate 4 therein comprises a bottom edge 12, which comprises a groove portion 8 provided with two V grooves 7. The bridging section 9 of the groove portion 8 is situated between the V grooves and the bridging section 9 is formed by partly omitting from the V groove 7 the second structure 14 that constitutes the shape of the V groove 7. For example, the bridging section 9 can be formed so that, at the upcoming bridging section 9, the second structure that constitutes the shape of the V groove 7 is removed from the V groove 7 along a portion with a length of the bridging section 9.

It is obvious to those skilled in the art that with the technology improving, the basic idea can be implemented in various ways. Thus, the invention and its embodiments are not limited to the examples described above but they may vary within the claims.

The invention claimed is:

1. A permanent cathode to be used as electrode in the electro-refining and/or recovery of metals, such as copper, zinc, cobalt or nickel, wherein the permanent cathode comprises a planar mother plate that is made of metal and comprises two sides;

wherein the mother plate comprises an edge, which at least partly surrounds the metal plate; and wherein the edge comprises a groove portion provided with a groove, wherein:

the groove portion comprises at least one bridging section for joining together, over the groove portion of the edge of the metal plate at the said at least one bridging section, the cathode metal halves, which are formed on the sides of the mother plate in the electro-refining of the metals, the groove portion is dimensioned and/or designed such that the cathode metal halves that are formed in electrorefining or electrowinning of metal on the sides of the mother plate are configured to at least partly be connected over the groove portion of the edge of the mother plate, and said at least one bridging section of the groove portion is dimensioned and/or designed such that the connection between the cathode metal halves at a bridging section of the groove portion is a stronger connection between the cathode metal halves over the edge of the mother plate than exists between the cathode metal halves over the edge of the mother plate at other parts of the groove portion.

2. A permanent cathode according to claim 1, further comprising a suspension means of the mother plate for suspending the mother plate in an electrolytic tank.

3. A permanent cathode according to claim 2, wherein at least one essentially parallel side edge is provided with an edge strip.

4. A permanent cathode according to claim 1, wherein the edge of the mother plate comprises two essentially parallel side edges and a bottom edge; and the groove portion is formed on the bottom edge of the mother plate.

5. A permanent cathode according to claim 4, wherein there is a straight and/or curved angular edge portion between each essentially parallel side edge and the bottom edge; and the groove portion extends to at least one angular edge portion.

6. A permanent cathode according to claim 1, wherein the groove portion comprises several grooves; and the bridging section is situated between two grooves.

7. A permanent cathode according to claim 1, wherein the bridging section is formed in the groove so that a section lower than the rest of the groove is formed in the groove, constituting the bridging section over the groove.

8. A permanent cathode according to claim 7, wherein the depth of the groove outside the bridging section is about 1-about 1.5 mm; and the depth of the groove at the bridging point is about 0.25-about 1 mm.

9. A permanent cathode according to claim 8, wherein the depth of the groove at the bridging point is about 0.25-about 0.75 mm.

10. A permanent cathode according to claim 9, wherein the depth of the groove at the bridging point is about 0.25-about 0.5 mm.

11. A permanent cathode according to claim 7, the edge of the mother plate comprises both a groove and an essentially flat portion at the bridging section.

12. A permanent cathode according to claim 1, wherein the edge of the mother plate is essentially flat at the bridging section.

13. A permanent cathode according to claim 1, wherein the groove is a V groove.

14. A permanent cathode according to claim 13, wherein the bridging section is formed by at least partly removing from the V groove the second half of the structure that constitutes the shape of the V groove at the bridging section.

15. A permanent cathode according to claim 1, wherein the width of the bridging section is about 5-about 50 cm.

16. A permanent cathode according to claim 15, wherein the width of the bridging section is about 10-about 40 cm.

17. A permanent cathode according to claim 16, wherein the width of the bridging section is about 20-about 30 cm.

18. A permanent cathode according to claim 1, wherein the bridging section forms an essentially flat portion at the groove section.

19. A permanent cathode according to claim 1, wherein the cathode metal halves comprise cathode copper halves, cathode zinc halves, cathode cobalt halves, or cathode nickel halves.

* * * * *